United States Patent [19]

Freze

[11] 3,995,988

[45] Dec. 7, 1976

[54] FUEL SAVING APPARATUS AND METHOD FOR TEXTILE DRYING AND FINISHING

[75] Inventor: Benjamin H. Freze, Garden Grove, Calif.

[73] Assignee: Challenge-Cook Bros., Incorporated, Industry, Calif.

[22] Filed: May 23, 1975

[21] Appl. No.: 580,487

[52] U.S. Cl. ..... 432/21; 432/105; 34/133

[51] Int. Cl.[2] ..... F26B 9/00; F26B 11/02; F27B 7/00

[58] Field of Search ..... 432/105, 103, 107, 21; 34/131, 133, 138, 139

[56] References Cited

UNITED STATES PATENTS

| | | | |
|---|---|---|---|
| 3,157,391 | 11/1964 | Angelone | 34/133 |
| 3,826,607 | 7/1974 | Kuhn | 34/133 |
| 3,831,294 | 8/1974 | Freze | 34/131 |
| 3,861,865 | 1/1975 | Grantham | 34/133 |
| 3,882,613 | 5/1975 | Wilson | 432/105 |

*Primary Examiner*—John J. Camby
*Assistant Examiner*—Henry C. Yuen
*Attorney, Agent, or Firm*—Lyon & Lyon

[57] ABSTRACT

An apparatus and method of textile drying and finishing wherein a portion of the discharge air from the dryer containing moisture is recirculated directly into the combustion zone of a burner wherein it is blended with fresh air then returned to the dryer.

12 Claims, 3 Drawing Figures

FUEL SAVING APPARATUS AND METHOD FOR TEXTILE DRYING AND FINISHING

BACKGROUND AND SUMMARY OF THE INVENTION

Drying and finishing drums utilizing a burner for heating the air which is circulated through textiles contained in a rotating drum have been used. Usually the heated air is passed through the drum, then vented. Attempts have been made to recirculate the air; however, the temperatures involved have resulted in slower drying and more water retension.

The present invention is directed to a means and method of drying and finishing textiles, utilizing a novelly arranged burner and a recirculating system wherein significant fuel savings are attained. More particularly, a controlled portion of the moist air from the dryer is recirculated directly into a secondary combustion zone of a burner where it is heated substantially and also blended with fresh air under conditions in which the following advantages are attained:

1. A significant fuel savings is realized while still maintaining equivalent drying rates and equivalent final water retention in the fabric.

2. Lint is consumed in a secondary combustion zone, thereby substantially reducing the amount of lint that normally must be discharged to the atmosphere or otherwise collected by expensive, laborious means and equipment.

3. There is a reduced tendency to scorch the textile surface due to the presence of a small amount of moisture that is recirculated into the textile as it dries.

4. A "softer touch" to the material is accomplished due to the mellowing effect of the moisture in the drying gases.

5. A more uniform drying is accomplished due to the moisture in the drying gases and due to the pressurizing effect that takes place in the drying zone as a result of recirculation.

6. The quantity of fresh make-up air is reduced substantially; thus proportionately reducing the ventilating requirements of the area in which the apparatus is used.

7. Air circulation rate through the textile is better maintained due to the reduction of make-up air requirement.

Figure 1:
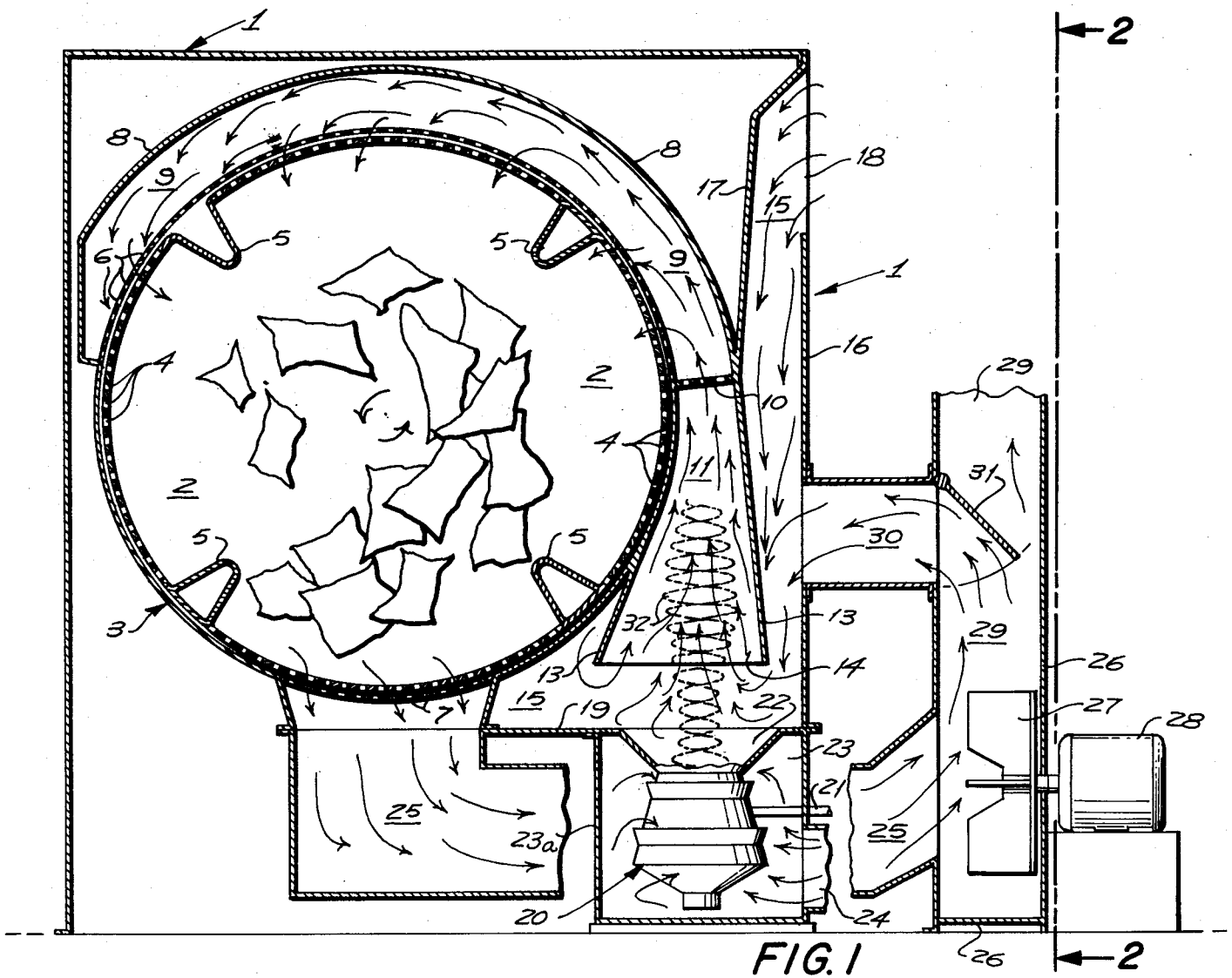
FIG. 1 is an essentially diagrammatical sectional view taken principally through 1—1 of FIG. 2.
Figure 2:
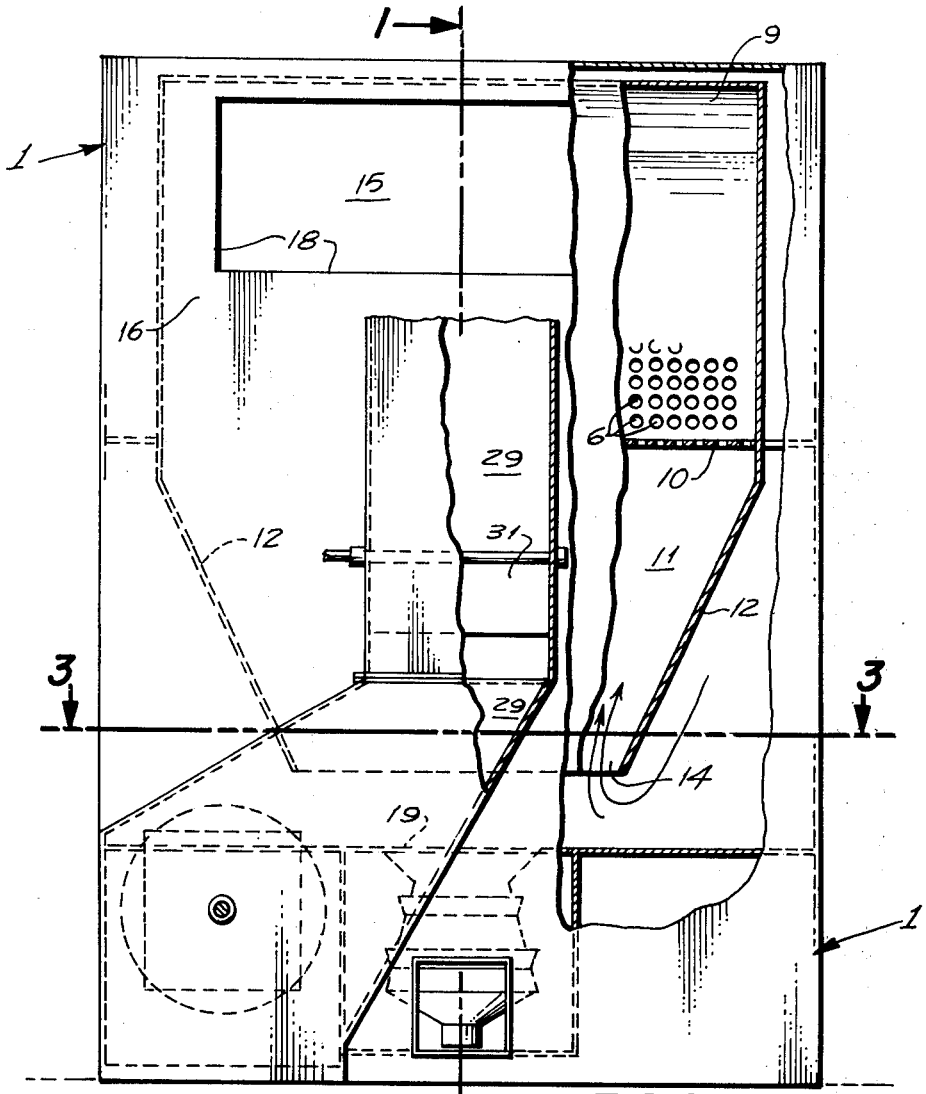
FIG. 2 is an essentially diagrammatical view taken from 2—2 of FIG. 1 with selected portions shown in section.
Figure 3:
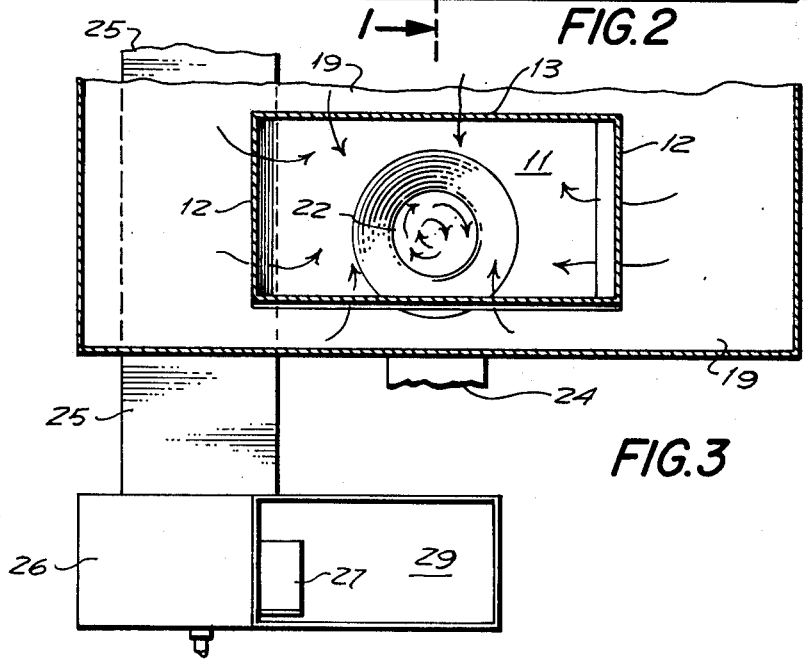
FIG. 3 is an essentially diagrammatical sectional view taken through 3—3 of FIG. 2.

The apparatus for textile drying and finishing is enclosed in an essentially rectangularly outer shell or housing 1, and includes a cylindrical drum 2 journaled in a cylindrical drum housing 3. The drum is, per se, conventional and is journaled for rotation in a conventional manner not shown. Also, the drum 2 is provided with conventional access doors, not shown, located at one or both ends. The peripheral surface of the drum is provided with perforations 4 and internally the drum is provided with conventional tumbler ribs 5.

Approximately the upper half of the drum housing 3 is provided with inlet perforations 6 and the bottom side of the housing 3 is provided with outlet perforations 7. Arched over the upper portion of the drum housing 3 is a semi-cylindrical wall 8 which forms with the region of the drum having the inlet perforations 6, a semi-cylindrical drum entrance chamber 9. At one peripheral end of the chamber 9 there is provided a perforated radial inlet wall 10.

Continuing downward from the inlet wall 10, in essentially tangential relation to the drum housing 3 is a secondary combustion chamber 11, having downwardly converging end walls 12 and downwardly diverging side walls 13, one of which may be formed in part by the drum housing 3. The lower extremity of the chamber 11 forms an entrance end 14.

Surrounding the secondary combustion chamber 11 for heat transfer thereto is an air inlet and preheating chamber 15, one wall of which is formed in part by the drum housing 3, and its opposite wall forms an end wall 16 of the shell or outer housing 1. The air inlet and preheating chamber 15 extends upwardly beyond the secondary combustion chamber 11 and is defined in part by an inner wall 17, joined to the wall 8 at the inlet wall 10. The upper end of the air inlet chamber 15 is provided with an air entrance opening 18 formed in the end wall 16. The bottom end of the air inlet chamber 15 is defined by a bottom wall 19 spaced downwardly from the entrance end of 14 of the secondary combustion chamber 11.

Depending from the bottom wall 19 is a burner 20, supplied by a fuel line 21. The burner 20 is conventional and is jointed at its upper end to a primary combustion chamber 22 having upwardly diverging walls. The burner 20 and the diverging walls of the chamber 22 are contained within a burner plenum chamber 23, having walls **23*a* and an air inlet duct 24.**

The area of the drum housing 3 provided with the outlet perforations 7 is connected to an outlet duct 25 which communicates with a blower housing 26, having a blower 27 therein driven by a motor 28. The blower discharges into an upwardly directed vent duct 29 having a side outlet directed into a return air duct 30 which communicates with the air inlet chamber 15. A control gate valve 31 is provided for directing a variable portion of air from the drum and drum housing into the return air duct 30. The duct 25, lower portion of the duct 29, the duct 30 and a portion of the air inlet chamber 15 form a recirculating duct means.

The method for textile drying and finishing utilizing the apparatus is as follows:

The burner generates a central column of combustion products indicated by 32, the lower end of which is in the primary combustion chamber 22, and continuous upwardly into the secondary combustion chamber 11. The column of combustion products having a temperature at the entrance to the secondary combustion chamber 11 in excess of 1000° F. Due to the operation of the blower 27, the combustion products and added air from the inlet chamber 15 flow upwardly to the secondary combustion chamber. The walls of the secondary combustion chamber 11 transfer heat to the surrounding air inlet chamber 15 to effect preheating of the incoming air occurs so that the resulting temperature in the drum entrance chamber 9 is compatable with the textile material contained in the drum. The drum inlet temperature being in the range between 400° and 600° F, depending upon the adjustment of the burner.

If the gate 31 is closed all cooling of the combustion product is accomplished by the extraneous air entering through the opening 18. However, by adjustment of the gate valve 31, a controlled amount of moisture laden air may be introduced into the air inlet chamber for preheating, then into the secondary combustion chamber 11 for final heating and removal of a portion of the moisture, then recirculation through the drum 2.

Due to the high temperature of the product of combustion, fuel savings are made possible as follows:

1. Energy gain from complex combustion processes; such as,
   Water catalyzed conversion of CO (ignition of CO if in the range of 1166° to 1319° F) and yields 4347 BTU per pound of water.
2. Removal of some of the moisture in the recirculated air by:
   A. Decomposition caused by temperatures in excess of 1100° F in the secondary combustion zone.
   B. Formation of halides.
3. Improvement of combustion efficiency as indicated by higher $CO_2$ in combustion products, due to:
   A. Introducing preheated air into the secondary combustion zone.
   B. Introducing moisture laden air into the high temperature secondary combustion zone.
   C. Effective distribution of recirculated air into the secondary combustion zone.
4. Reduction in energy loss by recirculating air that would normally be replaced by fresh air at lower temperature.
5. Blending of recirculated air with fresh air in the secondary combustion zone significantly increases moisture evaporation capacity of air entering the drying region. This is caused by the relative humidity due to elevated temperatures.

Tests conducted in which the duct 30 was closed, resulting in zero recirculation, and in which the duct 30 was open to effect 50% recirculation. The difference recorded for the energy required to remove a pound of water was as follows:

0% recirculation 2234 BTU per pound of water
50% recirculation 1920 BTU per pound of water This difference indicates a 14% reduction in fuel with recirculation.

Also, because of the high temperature at the entrance to the secondary combustion zone, entrained lint is consumed, thereby substantially reducing the amount of lint discharged to atmosphere. Also, the need for special equipment in the exhaust vent ducts 29 is minimized.

Having fully described my invention it is to be understood that I am not to be limited to the details herein set forth, but that my invention is of the full scope of the appended claims.

I claim:

1. Apparatus for drying and finishing textiles, comprising:

a. a dryer housing;
b. a perforated dryer drum rotatable in the housing;
c. a drum entrance chamber communicating with the interior of the drum for supplying heated air into the drum;
d. a secondary combustion chamber having an exit end connected to the drum entrance chamber and a downwardly directed entrance end, and a heat transfer wall;
e. a heater having an upwardly directed primary combustion chamber communicating with but spaced from the entrance end of the secondary combustion chamber;
f. a laterally air inlet and preheating chamber interposed between the primary and secondary combustion chambers and defined in part by the heat transfer wall of the secondary combustion chamber; and
g. a recirculating duct means for moistened air leading from the drum to the air inlet and preheating chamber for preheating contact with the walls of the secondary combustion chamber, and final heating within the secondary combustion chamber for reentry into the drum in a moisture absorbing condition.

2. Apparatus for drying and finishing textiles, as defined in claim 1, which further comprises:

a. an extraneous air inlet also communicating with the secondary combustion chamber through the air inlet and preheating chamber for supplying ambient air in addition to the recirculated air.

3. Apparatus for drying and finishing textiles, as defined in claim 2, wherein:

a. a blower is interposed in the recirculating duct means;
b. a vent duct branches from the recirculating duct means; and
c. a vent control means varies the amount of moistened air recirculated through the preheating chamber and secondary combustion chamber.

4. Apparatus for drying and finishing textiles, comprising:

a. an essentially cylindrical dryer housing;
b. a perforated dryer drum rotatable therein;
c. a semi-cylindrical drum entrance chamber overlying the housing for discharging heated air into the interior of the drum;
d. a secondary combustion chamber disposed in essentially tangential relation to the drum entrance chamber;
e. a heater having a primary combustion chamber in coaxial relation to the secondary combustion chamber, and spaced therefrom;
f. an extraneous air duct partially surrounding the secondary combustion chamber for heat transfer thereto through the walls of the secondary combustion chamber, and communicating therewith between the combustion chambers for mixture and further heating of the extraneous air by combustion products within the secondary combustion chamber; and
g. an air recirculating duct communicating between the drum and the extraneous air duct for extracting moist air from the drum and entraining recirculated air with extraneous air received in the secondary combustion chamber to heat the recirculated air to a moisture reducing and moisture absorbing condition.

5. An apparatus for drying and finishing textiles, as defined in claim 4, wherein:

a. a blower is interposed in the air recirculating duct;
b. a vent branches from the air recirculating duct; and
c. a vent control means proportions the amount of air recirculated through the drum.

6. A method of drying and finishing textiles, characterized by:

a. rotating moisturized textiles in a drum;

b. forming a primary combustion zone and a secondary combustion zone communicating with the drum, forming a preheating zone and a recirculating zone preceeding the secondary combustion zone;

c. passing air in a moisture absorbing condition from the secondary combustion zone through the drum to absorb moisture from the textiles; and d. recirculating the air and absorbed moisture through the recirculation zone, for preheating in the preheating zone and final heating in the secondary combustion zone, thereby to reestablish a moisture absorbing condition in the air.

7. A method, as defined in claim 6, further characterized by:

a. introducing extraneous air into the preheating zone and combustion zone for mixture with the recirculated air; and b. venting a corresponding portion of the air passing in the recirculated zone.

8. A method, as defined in claim 7, further characterized by:

maintaining the temperature in the combustion zone at a sufficient elevation to decompose the moisture entrained in the air passing through the combustion zone.

9. A method, as defined in claim 7, further characterized by:

maintaining the temperature in the combustion zone at a sufficient elevation to effect on energy gain due to water catalyzed conversion of carbon monoxide.

10. A method, as defined in claim 7, further characterized by:

maintaining the temperature in the combustion zone at a sufficient elevation to effect improved combustion efficiency due to the introduction of preheated air and moisture laden air into the secondary combustion zone.

11. A method, as defined in claim 7, further characterized by:

maintaining the temperature in the combustion zone at a sufficient elevation to consume lint entrained in the recirculated air.

12. A method of drying and finishing textiles, characterized by:

a. rotating moisturized textiles in a drum;

b. heating an air-fuel mixture in a primary combustion zone;

c. discharging the heated air-fuel mixture from the primary combustion zone into a secondary combustion zone having an entrance end spaced from the primary combustion zone;

d. preheating extraneous air and entraining the extraneous air into the entrance end of the secondary combustion zone to complete combustion and heat the extraneous air to form a heated gaseous mixture;

e. distributing the heated gaseous mixture from the secondary combustion zone into the drum, to absorb the moisture content of the textiles;

f. extracting the absorbed moisture and gaseous mixture from the drum; and g. preheating then introducing the gaseous mixture and absorbed moisture into the entrance end of the secondary combustion zone thereby to effect a heat exchange between the moisture and heated air-fuel mixture thereby raising the moisture temperature to a gaseous state of extremely low relative humidity with high moisture absorbtion capabilities.

* * * * *